US006736570B2

(12) United States Patent
Garza

(10) Patent No.: US 6,736,570 B2
(45) Date of Patent: May 18, 2004

(54) PRECAST SAFETY END AND FORM THEREFOR

(75) Inventor: Rufino Garza, Mission, TX (US)

(73) Assignee: L&R Pre-Cast Concrete Works, Mission, TX (US)

( * ) Notice: Subject to any disclaimer, the term of this patent is extended or adjusted under 35 U.S.C. 154(b) by 0 days.

(21) Appl. No.: 10/247,343

(22) Filed: Sep. 20, 2002

(65) Prior Publication Data

US 2003/0194269 A1 Oct. 16, 2003

Related U.S. Application Data

(63) Continuation-in-part of application No. 29/159,036, filed on Apr. 16, 2002, now Pat. No. Des. 469,519.

(51) Int. Cl.[7] ..... E01F 5/00
(52) U.S. Cl. ..... 405/125; 405/124
(58) Field of Search ..... 405/124, 125, 405/126, 127, 36, 39, 40

(56) References Cited

U.S. PATENT DOCUMENTS

| | | | | | |
|---|---|---|---|---|---|
| 354,897 | A | * | 12/1886 | Goodridge, Jr. | 405/125 |
| 1,144,200 | A | | 6/1915 | Hewett | |
| 1,452,796 | A | * | 4/1923 | De la Mare | 405/125 |
| 2,263,588 | A | | 11/1941 | Odendahl | |
| 2,636,352 | A | | 4/1953 | Alger | |
| 4,457,646 | A | * | 7/1984 | Laesch | 405/36 |
| 4,564,313 | A | | 1/1986 | Niswander et al. | |
| 4,673,159 | A | | 6/1987 | Schmidgall | |
| 4,993,872 | A | | 2/1991 | Lockwood | |
| 5,536,113 | A | | 7/1996 | McGregor | |
| 5,836,717 | A | | 11/1998 | Bernini | |
| 6,004,068 | A | | 12/1999 | Hosley | |
| 6,203,245 | B1 | | 3/2001 | Harten | |
| D447,543 | S | | 9/2001 | Quin | |
| D447,544 | S | | 9/2001 | Quin | |
| 6,394,700 | B1 | * | 5/2002 | Fish | 405/124 |
| D469,519 | S | * | 1/2003 | Garza, Jr. | D23/259 |
| 6,533,498 | B1 | * | 3/2003 | Quin | 405/125 |

FOREIGN PATENT DOCUMENTS

| | | | | |
|---|---|---|---|---|
| GB | 2076867 | * | 12/1981 | 405/125 |

OTHER PUBLICATIONS

Photographs of a conventional safety end for a culvert, believed to have been in use prior to Apr. 16, 2001.

(List continued on next page.)

*Primary Examiner*—Frederick L. Lagman
(74) *Attorney, Agent, or Firm*—Jacobson Holman PLLC

(57) ABSTRACT

A precast safety end for use with culverts on highway, driveway, and road drainage crossings has a base having a depending flange at its outer end and an upright wall at its inner end, and opening in the wall to register with the opening in an abutting pipe culvert. Upright wings on each side of the base connect with the upright end wall. The side walls taper downwardly from the upright end wall to the end of the base. The side walls have outwardly protruding wings on either side to prevent erosion and overgrowth of grass. A form for casting the safety end includes an inner, main form member and two outer side form members that define a void in the shape of the base and side walls, an inner end wall form member and a channel forming member extending between the inner end wall form member and the main form member that with the main form member define a void in the shape of the upright end wall, and an outer end form member and a cross-piece that together with the outer end form member and the main form member define a void in the shape of the projecting flange.

27 Claims, 5 Drawing Sheets

OTHER PUBLICATIONS

"Precast Safety End Treatment Type II Riprap Details PSET–RR," *Texas Department of Transportation Bridge Division* (Oct. 2001).

"Precast Safety End Treatment Type II ~ Cross Drainage PSET–SC," *Texas Department of Transportation Bridge Division* (Sep. 2000).

"Precast Safety End Treatment Type II ~ Parallel Drainage PSET–RP," *Texas Department of Transportation Bridge Division* (Sep. 2000).

"Precast Safety End Treatment Type II ~ Cross Drainage PSET–RC," *Texas Department of Transportation Bridge Division* (Sep. 2000).

* cited by examiner

PRECAST SAFETY END AND FORM THEREFOR

This application is a continuation-in-part of U.S. application Ser. No. 29/159,036, filed Apr. 16, 2002, now U.S. Pat. No. D,469,519 which is incorporated herein by reference in its entirety.

BACKGROUND OF THE INVENTION

1. Field of the Invention

The invention relates to a precast end or terminal for culverts and a form for casting the end. More specifically, the invention relates to a precast end with improved safety features and the form therefor.

2. Related Art

Precast concrete end walls (which may also be known as terminals or bulkheads) applied at the delivery or receiving end of culverts are known in the prior art. Examples are described in U.S. Pat. No. 1,144,200 to Hewett and U.S. Pat. No. 2,263,588 to Odendahl, both of which are incorporated herein in their entireties. Typically, conventional "safety" end walls have an upward slope for deflection of vehicles at highway, driveway, and road drainage crossings. However, conventional safety end walls are of limited value in controlling the overgrowth of grass and other vegetation, and in controlling erosion along the sides.

The current method of forming a culvert end wall requires cutting a precast pipe, placing the cut precast pipe, pouring a concrete apron to complete the culvert end, and then waiting 48 hours while the concrete cures.

It is to the solution of these and other problems that the present invention is directed.

BRIEF SUMMARY OF THE INVENTION

It is accordingly a primary object of the present invention to provide a safety end that can control the overgrowth of vegetation and can also control erosion.

It is another object of the present invention to provide a safety end that has improved strength characteristics.

It is still another object of the present invention to provide a form for a precast safety end that enables placement of the safety end in one step.

These and other objects of the present invention are achieved by the provision of a precast safety end for use with culverts on highway, driveway, and road drainage crossings, and a form for making the precast safety end. The precast safety end has a base having a depending flange at its outer end and an upright wall at its inner end, and opening in the wall to register with the opening in an abutting pipe culvert. Upright side walls on each side of the base connect with the upright end wall. The side walls taper downwardly from the upright end wall to the end of the base. The side walls have outwardly protruding wings on either side to prevent erosion and overgrowth of grass.

The form comprises an inner, main form member and two first and second outer side form members and that define a void in the shape of the base and side walls, an inner end wall form member and a channel forming member extending between the inner end wall form member and the main form member that with the main form member define a void in the shape of the upright end wall, and an outer end form member and a cross-piece that together with the outer end form member and the main form member define a void in the shape of the projecting flange.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE INVENTION

Figure 1:
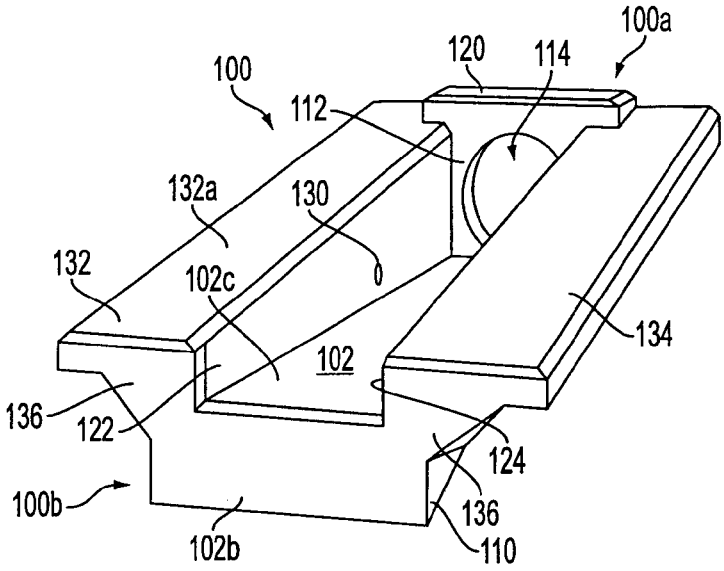
FIG. 1 is an outer end perspective view of a precast safety end in accordance with the present invention.
Figure 2:
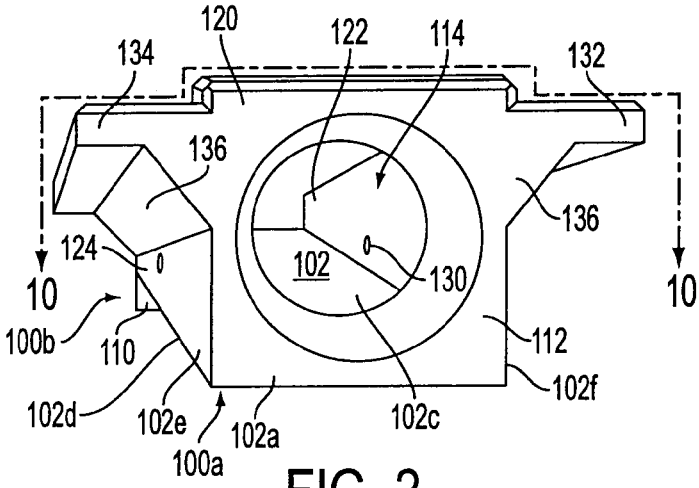
FIG. 2 is an inner end perspective view of the precast safety end of FIG. 1.
Figure 3:
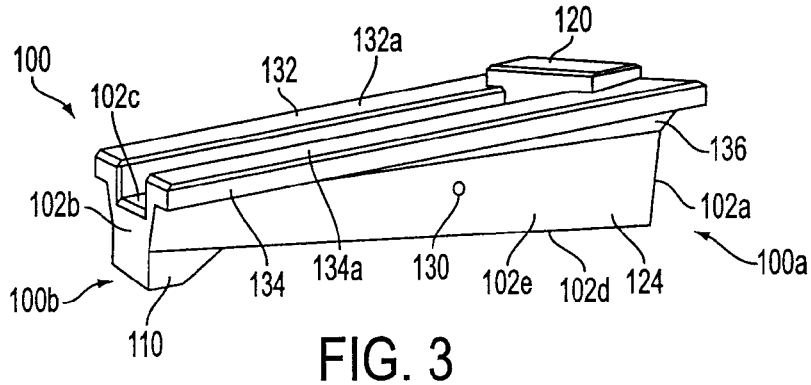
FIG. 3 is a side perspective view of the precast safety end of FIG. 1.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Referring now to FIGS. 1-3 and 6-8, there is shown a monolithic precast safety end 100 in accordance with the present invention. The safety end 100 has an inner end 100*a*, which abuts an end of a culvert pipe (not shown), and an outer end 100*b* distal the inner end 100*a*. The safety end 100 is formed from precast concrete as a monolithic structure.

The safety end 100 comprises a base 102 having opposed inner and outer end surfaces 102*a* and 102*b*, opposed upper and lower surfaces 102*c* and 102*d*, and opposed first and second side surfaces 102*e* and 102*f*. The inner and outer end surfaces 102*a* and 102*b* are substantially parallel to each other, the first and second side surfaces 102*e* and 102*f* are substantially parallel to each other, and the upper and lower surfaces 102*c* and 102*d* are substantially parallel to each other.

A flange 110 projects downwardly from the lower surface 102*d* of the base 102 at the outer end 100*b* of the safety end 100. The flange 110 anchors the safety end 100 in place against lengthwise movement. Accordingly, it preferably projects below the lower surface 102*d* of the base 102 approximately 6 inches. Also preferably, the flange 110 has a trapezoidal cross-section, joining the lower surface 102*d* of the base 102 at an angle of approximately 135°.

An upright inner end wall 112 extends upwardly from the base 102 at the inner end 100*a* of the safety end 100. Preferably, the inner end wall 112 is substantially perpendicular to the upper surface 102*c* of the base 102. The inner end wall 112 has an opening 114 therein, as will be described in greater detail hereinafter, and a lintel-like structure 120 spanning the opening 114, which provides a load-carrying function above the opening 114.

Upright first and second side walls 122 and 124 extend upwardly from the base 102 forwardly of the inner end wall 112 to the outer end 100*b* of the safety end 100, the first and second side walls 122 and 124 being joined to the sides of the inner end wall 112 and terminating at the bottom of the lintel-like structure 120. The first and second side walls 122 and 124, together with the inner end wall 112 and the base 102, define the interior of the safety end 100. Preferably the first and second side walls 122 and 124 are substantially perpendicular to the upper surface 102*c* of the base 102. The first and second side walls 122 and 124 are in the shape of a right trapezoid, with their height increasing from the outer end 100*b* to the inner end 100*a* of the safety end 100. Preferably, the first and second side walls 122 and 124 include holes 130 therethrough, which can be used to lift up the safety end 100 from the ground.

Cantilevered first and second wings 132 and 134 extend outwardly from the tops of the first and second side walls 122 and 124, respectively. The upper surfaces 132*a* and 134*a* of the first and second wings 132 and 134 are substantially perpendicular to the inner surfaces of the first and second side walls 122 and 124, respectively, and consequently the upper surfaces 132*a* and 134*a* of the first and second wings 132 and 134 slope upwardly from the outer end 100*b* to the inner end 100*a* of the safety end 100. The wings thus provide an upward safety slope for deflection of a vehicle. The magnitude of the slope will depend upon the overall length of the safety end 100, the magnitude of the slope decreasing as the overall length of the safety end 100 increases. Exemplary proportions are set forth in the Table below. Haunches 136 are formed integrally at the joints between the underside of the first and second wings 132 and 134 and the outer surfaces of the first and second side walls 122 and 124, respectively, for reinforcement. Preferably, the haunches 136 have a substantially triangular cross-section and have a height at least equal to that of the wings. The reinforced wings thus provide a structure that increases the strength of the overall safety end 100 while controlling vegetation overgrowth and soil erosion around the safety end 100.

TABLE

| Safety end length | Slope |
|---|---|
| 54 inches | 3:1 |
| 68 inches | 4:1 |
| 96 inches | 6:1 |

Figure 6:
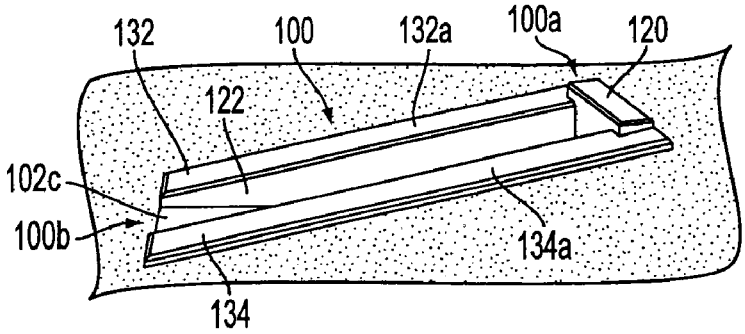
FIG. 6 is a side perspective view of the precast safety end of FIG. 1 installed at the end of a culvert.
Figure 7:
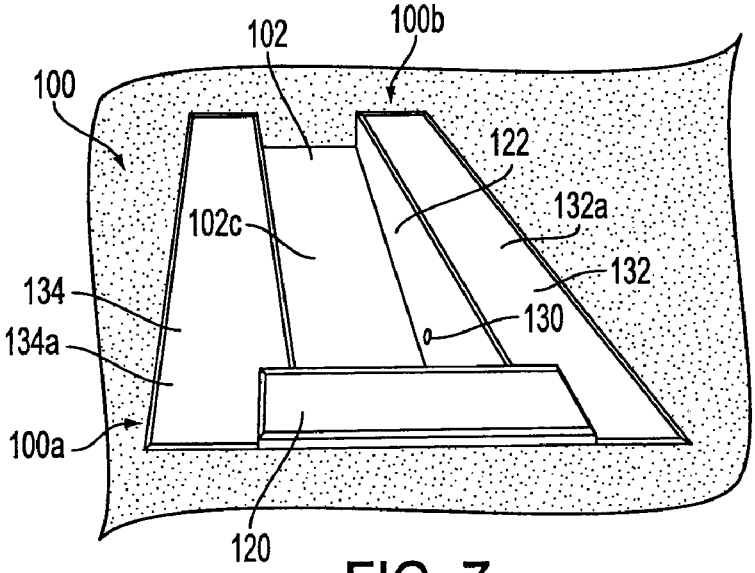
FIG. 7 is an inner end perspective view of the installed precast safety end of FIG. 6.
Figure 8:
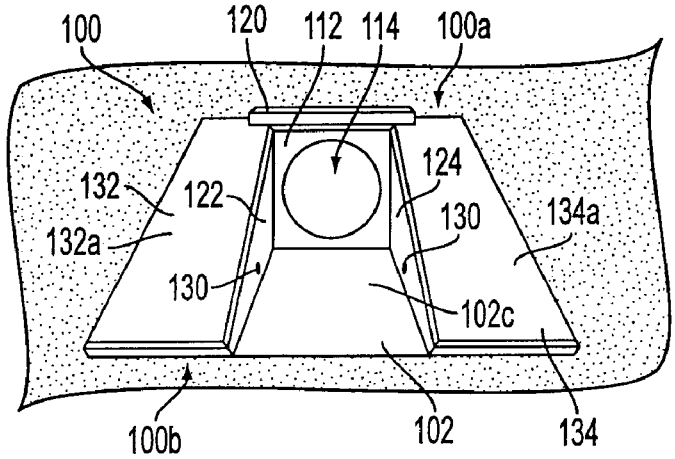
FIG. 8 is an outer end perspective view of the installed precast safety end of FIG. 6.

As can be seen from FIGS. 6-8, when the safety end 100 is set in place at the end of a culvert pipe, the upper surfaces 132*a* and 134*a* of the wings 132 and 134 are substantially level with the ground, and the flange 110 is below ground level.

The opening 114 provided in the inner end wall 112 is configured to receive the end of the culvert pipe. Preferably, the opening 114 is of a two-part, stepped configuration, with the two parts being coaxial. The first, inner part 114*a* of the opening 114 opens into the interior of the safety end 100 and is complimentary in size and shape to the outer perimeter of the conduit pipe. The second, outer part 114*b* of the opening 114 opens into the exterior of the safety end 100 and is complimentary in size and shape to the inner perimeter of the conduit pipe. Preferably, the bottom of the second part is level with the upper surface 102*c* of the base 102, and the top of the second part is level with the bottom of the lintel-like structure 120.

Normnally, the opening 114 will be circular, but it will be appreciated by those of skill in the art that the opening 114 can be provided in other configurations, such as rectangular, to accommodate culvert pipes having non-circular cross-sections. The top of the inner end wall 112 extends above the upper surface of the first and second wings 132 and 134, and overlaps the first and second wings 132 and 134 above the first and side walls 122 and 124 to define the lintel-like structure 120 that spans the opening 114 and provide a load-carrying function above the opening 114.

Figure 9:
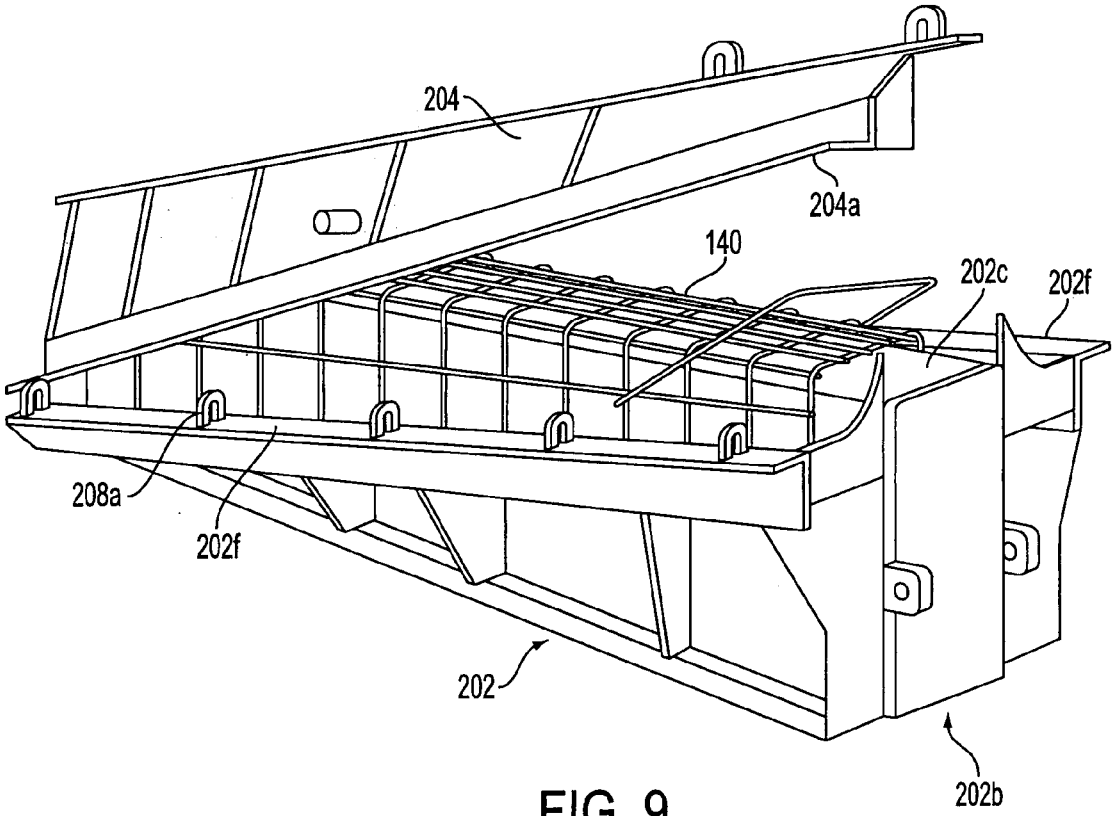
FIG. 9 is a partially assembled view of the form of FIG. 4.
Figure 10:
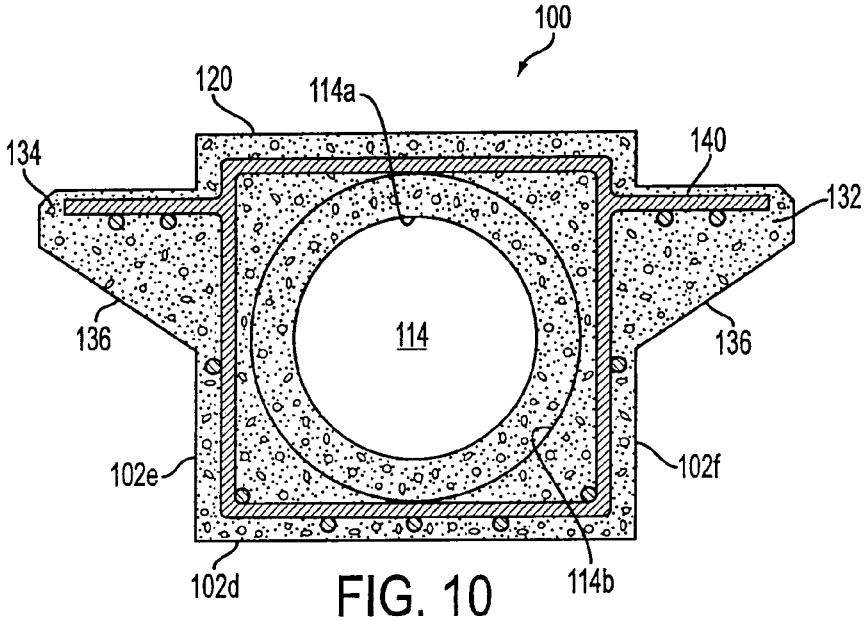
FIG. 10 is a cross-sectional view taken along line 10—10 of FIG. 2.

As shown in FIG. 10 (and also with reference to FIGS. 4 and 9), a rebar cage 140 extends through the base 102, the first and second side walls 122 and 124, and the wings of the safety end 100, as well as through the lintel-like structure 120.

Figure 4:
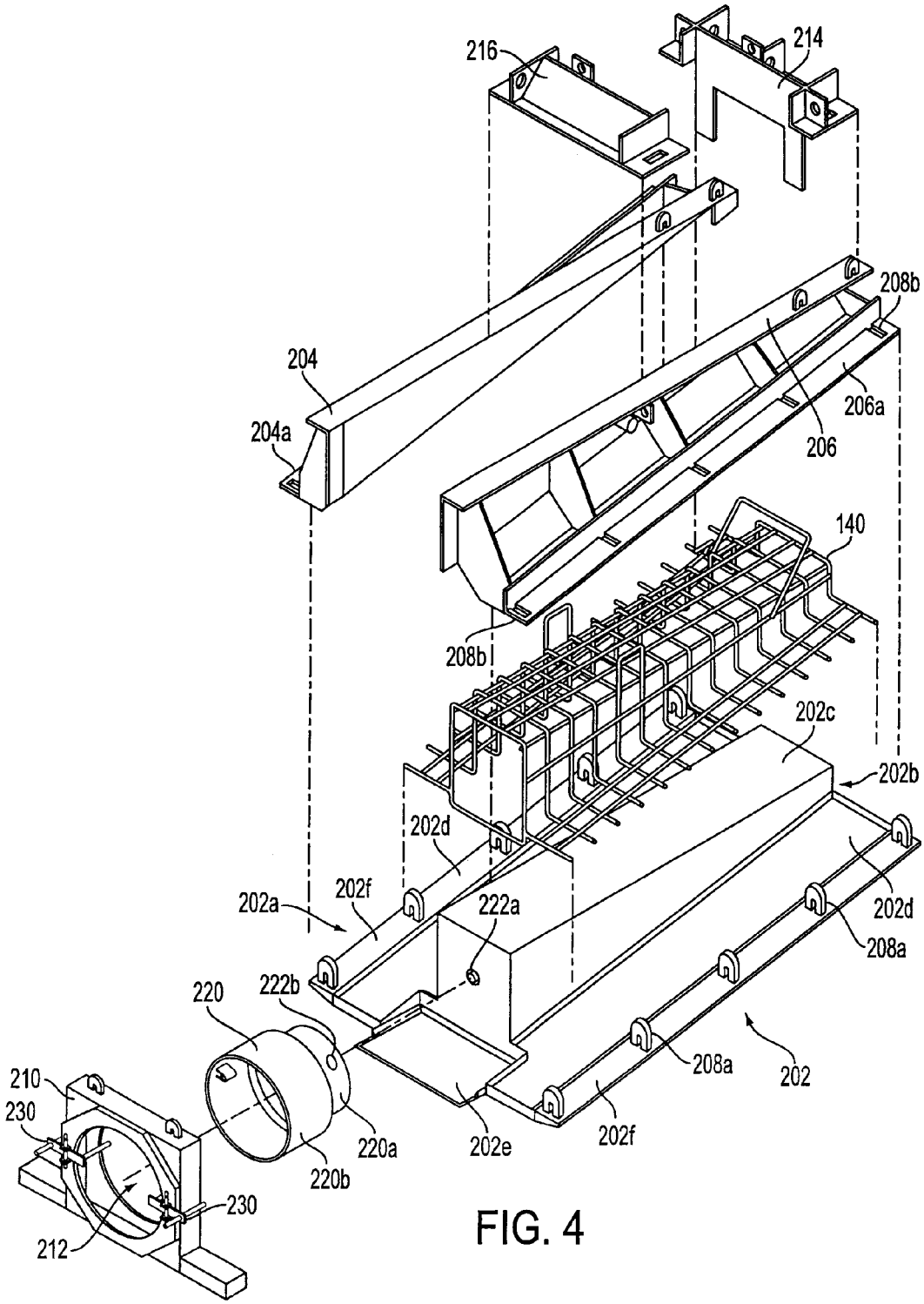
FIG. 4 is an exploded view of a form in accordance with the present invention for casting the precast safety end of FIG. 1.
Figure 5:
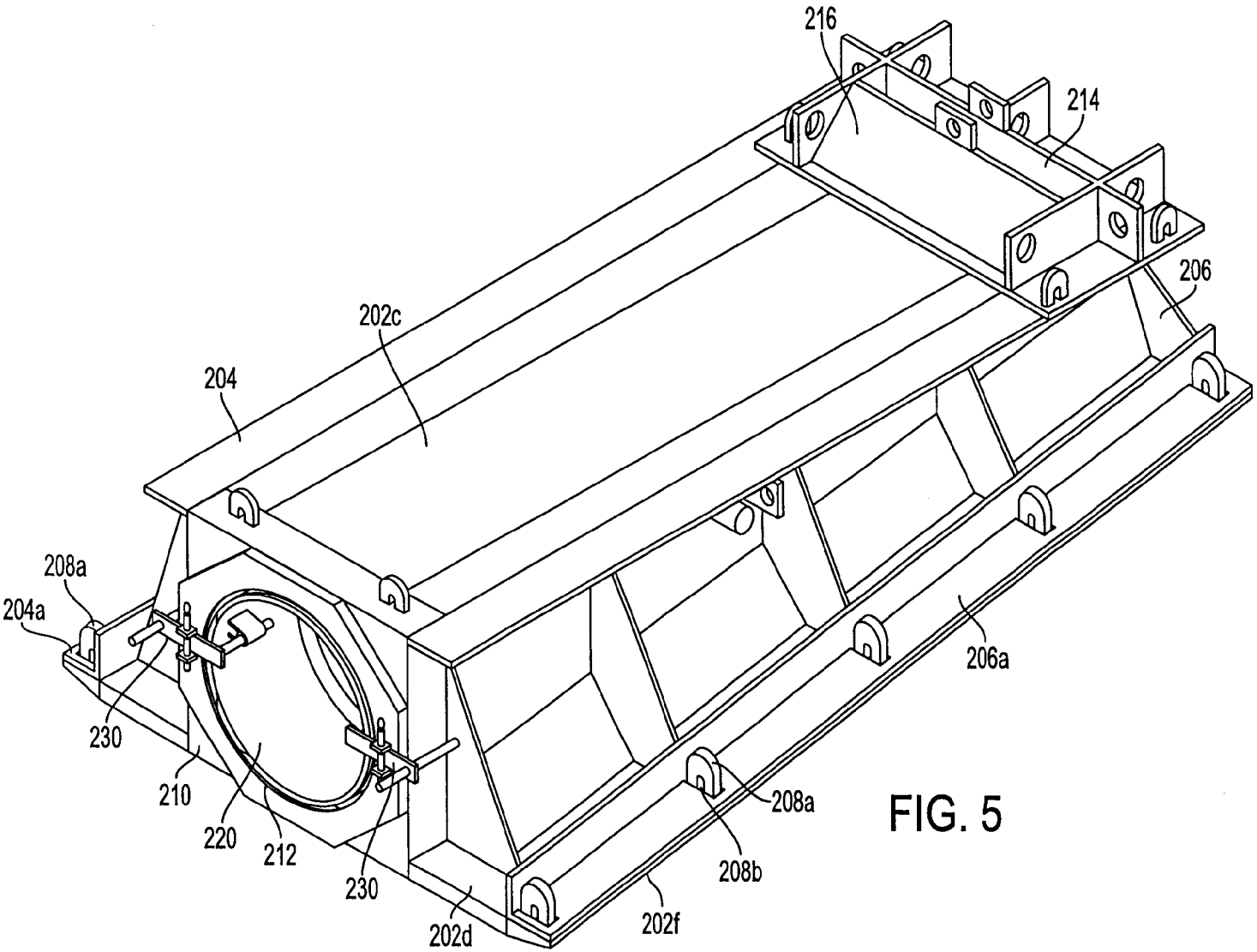
FIG. 5 is an assembled view of the form of FIG. 4.

Referring now to FIGS. 4 and 5, there is shown a form 200 for casting a safety end 100 in accordance with the present invention. The form 200 comprises an inner, main form member 202, two outer side form members 204 and 206, an inner end wall form member 210, an outer end form member 214, a cross-piece 216, and a channel form member 220.

The main form member 202 has inner and outer ends 202*a* and 202*b*, a central part 202*c*, two side shoulders 202*d*, and an outer end projection 202*e*. The central part 202*a* is approximately in the shape of a rectangular prism. The side shoulders 202*b* extend diagonally along the sides of the central part 202*a* from the outer end 202*b* to the inner end 202*a*, extending beyond the end of the central part 202*c* at the inner end 202*a* on either side of the end projection 202*e*. The side edges of side shoulders 202*d* terminate in side rails 202*f*, which, when the form 200 is assembled, are in alignment with side rails 204*a* and 206*a* at the lower side edges of the outer side form members 204 and 206. The side rails 202*f* and the side rails 204 and 206 preferably have mating male and female parts 208*a* and 208*b* (for example, lugs and slots) to align the outer side form members 204 and 206 relative to the main form member 202 and retain them in position.

When the form 200 is assembled, the outer side form members 204 and 206 are placed over the side shoulders 202*d* of the main form member 202 adjacent the sides of the main form member, the inner end wall form member 210 is placed adjacent the inner end 202*a* of the main form member 202, and the channel form member 220 extends between the inner end wall form member 210 and the central part 202*c* of the main form member 202. It will be appreciated by those of skill in the art that the various parts of the form 200, The upper surface of the main form member 202 is in effect the negative of the surfaces of the of the safety end 100 that are exposed when the safety end 100 is installed. The inner, main form member 202 and two outer side form members 204 and 206 define a void in the shape of the base 102, the side walls 122 and 124, and the wings 132 and 134. The inner end wall form member 210, and the channel form member 220 together with the main form member 202 define a void in the shape of the upright inner end wall 112 and the lintel-like structure 120. The outer end form member 214 and the cross-piece 216, together with the outer end form member 214 and the main form member 202, define a void in the shape of the projecting flange 110. It will be appreciated by those of skill in the art that the various parts of the form 200 can be scaled to cast safety ends of varied sizes, which can accommodate pipes of varied sizes.

The channel form member 220 is configured to define the opening 114 provided in the inner end wall 112, and thus, like the opening 114, is of a two-part, stepped configuration, with the two parts 220*a* and 220*b* being coaxial. The inner end wall form member 210 has an opening 212 therein that engages the outer part 220*b* of the channel form member 220 to align it and retain it in place. The inner part 220*a* of the channel form member 220 and the main form member 202 preferably have mating male and female parts 222*a* and 222*b* to align the channel form member 220 relative to the main form member 202 and retain it in position. Fasteners, for example mating pin and bracket-type fasteners 230, can be used to affix the outer part 220*b* of the channel form member 220 to the inner end wall form member 210 and to the inner ends of the first and second outer side form members 204 and 206.

The method of forming a safety end 100 using the form 200 in accordance with the invention will now be described. First, rebar is cut to specific measurements according to the size of the safety end being made, and all pieces of rebar are welded together according to conventional practice to form a rebar cage 140. If the form 200 has previously been used, it is taken apart and scraped to remove any leftover cement particles. The clean form 200 is then sprayed with a release detergent so that the cement will not stick to the inner surfaces of the form 200. The rebar cage 140 is then set on the main form member 202 and the form 200 is re-assembled. Next, the fully assembled form 200 with the rebar cage 140 in place is set on a vibrating table. Cement is poured into the form 200 and the vibrating table is turned on. The cement in the form 200 is then patched up using wet cement to make sure the cement is spread evenly. The cast safety end 100 is then allowed to dry for 4 to 6 hours. Finally, after the end of the drying period, the form 200 is stripped down and the finished safety end 100 is removed.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

I Claim:

1. A monolithic precast safety end having an inner end abutting an end of a culvert pipe and an outer end distal the inner end, the safety end comprising:

a base having opposed inner and outer end surfaces, opposed upper and lower surfaces, and opposed first and second side surfaces;

an upright inner end wall extending upwardly from the inner end of the base, the inner end wall having an opening therein, inner and outer surfaces, and first and second sides;

upright first and second side walls extending upwardly from the base forwardly of the inner end wall, the first and second side walls being joined to the sides of the inner end wall, the first and second side walls being in the shape of a right trapezoid, with their height increasing from the outer end to the inner end of the safety end;

cantilevered first and second wings extending outwardly from the tops of the first and second side walls, respectively, the first and second wings each having an underside forming a joint with the first and second side walls; and reinforcing haunches formed integrally at the joints between the underside of the first and second wings and the first and second side walls.

2. The safety end of claim 1, wherein the upper edges of the first and second side walls and the upper surfaces of the first and second wings are at an angle relative to the upper surface of the base, whereby when the upper surface of the base is in a substantially horizontal position, the first and second wings slope upwardly from the outer end of the safety end to the inner end of the safety end.

3. The safety end of claim 2, wherein the magnitude of the slope of the first and second wings depends upon the overall length of the safety end, the magnitude of the slope decreasing as the overall length increases.

4. The safety end of claim 1, wherein the first and second side walls are substantially parallel to each other.

5. The safety end of claim 1, wherein the inner end wall and the first and second side walls are substantially perpendicular to the upper surface of the base.

6. The safety end of claim 1, wherein the first and second side walls extend to the outer end of the safety end.

7. The safety end of claim 1, further comprising a flange projecting downwardly from the lower surface of the base at the outer end of the safety end.

8. The safety end of claim 7, wherein the flange has a trapezoidal cross-section.

9. The safety end of claim 8, wherein the flange joins the lower surface of the base at an angle of approximately 135°.

10. The safety end of claim 1, further comprising a lintel-like structure spanning the opening.

11. The safety end of claim 10, wherein the top of the inner end wall extends above the upper surface of the first and second wings, and overlaps the first and second wings above the first and side walls to define the lintel-like structure.

12. The safety end of claim 11, wherein the first and second side walls terminate at the bottom of the lintel-like structure.

13. The safety end of claim 1, further comprising a rebar cage extending through the base, the first and second side walls, and the wings.

14. The safety end of claim 11, further comprising a rebar cage extending through the base, the first and second side walls, the wings, and the lintel-like structure.

15. The safety end of claim 1, wherein the reinforcing haunches have a substantially triangular cross-section.

16. A monolithic precast safety end having an inner end abutting an end of a culvert pipe and an outer end distal the inner end, the safety end comprising:

a base having opposed inner and outer end surfaces, opposed upper and lower surfaces, and opposed first and second side surfaces;

an upright inner end wall extending upwardly from the inner end of the base, the inner end wall having an opening therein, inner and outer surfaces, and first and second sides;

upright first and second side walls extending upwardly from the base forwardly of the inner end wall, the first and second side walls being joined to the sides of the inner end wall, the first and second side walls being in the shape of a right trapezoid, with their height increasing from the outer end to the inner end of the safety end; and deflection means located at the tops of the first and second side walls, respectively, for providing an upward safety slope for deflection of a vehicle.

17. The safety end of claim 16, wherein the magnitude of the slope of the deflection means depends upon the overall length of the safety end, the magnitude of the slope decreasing as the overall length increases.

18. The safety end of claim 16, wherein the first and second side walls are substantially parallel to each other.

19. The safety end of claim 16, wherein the inner end wall and the first and second side walls are substantially perpendicular to the upper surface of the base.

20. The safety end of claim 16, wherein the first and second side walls extend to the outer end of the safety end.

21. The safety end of claim 16, further comprising means for anchoring the safety end in place against lengthwise movement.

22. The safety end of claim 16, further comprising a lintel-like structure spanning the opening.

23. The safety end of claim 22, wherein the top of the inner end wall overlaps the deflection means to define the lintel-like structure.

24. The safety end of claim 23, wherein the first and second side walls terminate at the bottom of the lintel-like structure.

25. The safety end of claim 16, further comprising means extending through the base, the first and second side walls, and the deflection means for reinforcing the base, the first and second side walls, and the deflection means.

26. The safety end of claim 23, further comprising means extending through the base, the first and second side walls, the deflection means, and the lintel-like structure for reinforcing the base, the first and second side walls, the deflection means, and the lintel-like structure.

27. The safety end of claim 16, further comprising means integral with the deflection means and the first and second side walls for reinforcing the deflection means.

* * * * *